US006613154B1

(12) United States Patent
Lester

(10) Patent No.: US 6,613,154 B1
(45) Date of Patent: Sep. 2, 2003

(54) WELL CLEANING APPARATUS AND METHOD FOR ITS USE

(75) Inventor: Curtis Lester, Lubbock, TX (US)

(73) Assignee: Goulds Pumps, Incorporated, Seneca Falls, NY (US)

( * ) Notice: Subject to any disclaimer, the term of this patent is extended or adjusted under 35 U.S.C. 154(b) by 240 days.

(21) Appl. No.: 09/703,125

(22) Filed: Oct. 30, 2000

(51) Int. Cl.[7] ..... B08B 9/40

(52) U.S. Cl. ..... 134/8; 166/173; 166/312; 15/104.09; 15/104.095

(58) Field of Search ..... 134/8; 166/170, 166/173, 223, 311, 312; 15/104.09, 104.095, 104.16, 104.2, 104.12

(56) References Cited

U.S. PATENT DOCUMENTS 4,438,812 A * 3/1984 Hammon ..... 15/104.2
4,461,051 A * 7/1984 Schindel ..... 15/104.095
5,244,505 A * 9/1993 Allison et al. ..... 134/22.11
5,711,046 A * 1/1998 Potter ..... 15/104.16
5,836,394 A * 11/1998 Blank ..... 166/223
5,839,511 A * 11/1998 Williams ..... 166/223
6,401,813 B1 * 6/2000 Carmichael et al. ..... 166/173

* cited by examiner

*Primary Examiner*—Randy Gulakowski
*Assistant Examiner*—Saeed Chaudhry
(74) *Attorney, Agent, or Firm*—Brezina & Ehrlich

(57) ABSTRACT

An apparatus for cleaning a well casing and a method for its use. The apparatus includes: a coupling having first and second ends, the first end constructed and arranged for connection to a drill stem of a drilling rig having vertical and rotational motion and means for pumping liquid therethrough to the coupling, the coupling having a central passageway therethrough connected to the means for pumping liquid; a drill collar tube having first and second ends, the first end of the drill collar tube connected to the second end of the coupling, the drill collar tube having a central passageway therethrough connected to the central passageway of the coupling, an outer surface, a plurality of nozzles disposed between the central passageway and the outer surface, and closure means for closing the second end of the drill collar tube; and a plurality of brushes disposed generally perpendicularly to the outer surface of the drill collar tube.

9 Claims, 2 Drawing Sheets

WELL CLEANING APPARATUS AND METHOD FOR ITS USE

BACKGROUND OF THE INVENTION

1. Field of the Invention

The invention relates to the field of well refurbishing, and more specifically to cleaning devices for use in cleaning well casings.

2. Description of Related Art

Well casings have perforations, vertical slots in the wall of the casing that let the water flow into the casing. These perforations are small enough that rocks and other debris are prevented from entering the inside of the casing. The casing is disposed in the earth so that only the perforated area is positioned in the ground formation where the water is located.

After a period of time, the perforations in well casing can become closed due to corrosion or bacterial growth, with scale and rust forming on the inside of the casing. This corrosion causes a decrease in the volume of water that can flow into casing to be pumped out, and over time the flow of the water can be decreased drastically, and in some cases, to the point that the well can not produce enough flow to be profitable and must be abandoned. Well casing refurbishing is done to increase the volume of water that can flow into the well casing during a pumping operation. By opening up the perforations and cleaning the casing, the volume of water that can freely flow into the casing increases. Several methods are known for refurbishing well casings.

In the bucket method, a pulling rig is used that has only the capability of up and down cable motion. Cleaning chemicals are poured into the well, and a large metal bucket is then lowered into the well casing with the rig and positioned at the bottom of the area where the perforations are located. The bucket is then pulled up rapidly and then dropped a number of times. By doing this, the water in the casing is agitated, with some loosening of the corrosion in the perforations and the rust and scale on the inside of the casing.

The effectiveness of this method is based on the cleaning chemical loosening the buildup of corrosion and scale in the perforations and casing, plus the reaction caused by the movement of the water. However, since there is no brush scrubbing the buildup on the well casing, it usually takes a number of repetitions to realize only a small improvement. The perforations are not effectively cleaned.

In the brush method, a pulling rig is again used that only has the capability of up and down cable motion. This method utilizes a device comprising a pipe with short pieces of steel cable mounted perpendicularly to the body of the pipe, forming a type of heavy metal brush. Cleaning chemicals are poured into the well, and the brush is lowered into the well casing and positioned at the bottom of the perforations. The brush is then slowly pulled up, with the steel cable scrubbing the inside of the casing and opening up some of the perforations.

The brush method is not effective in cleaning the corrosion and scale buildup all the way around the inside of the casing. Since the movement is only up and down, there are large portions of the perforated area that are not cleaned properly. This method also has the disadvantage that scale removed from the casing will be brushed into the perforations and plug them up. Moreover, care must be taken with this type of brush to limit the scrubbing so the casing is not damaged.

SUMMARY OF THE INVENTION

It is therefore an object of the invention to provide an apparatus for cleaning a well casing that effectively removes scale and corrosion around the entirety of the casing, without damaging the casing.

In order to achieve this and other objects, the invention is directed to an apparatus for cleaning a well casing comprising three components:

1. A coupling having first and second ends, the first end constructed and arranged for connection to a drill stem of a drilling rig having vertical and rotational motion and means for pumping liquid therethrough to the drill stem. The coupling has a central passageway therethrough connected to the means for pumping liquid;

2. A drill collar tube comprising a central passageway therethrough connected to the central passageway of the coupling at one end of the drill collar tube, a closure at the opposite end of the drill collar tube, an outer surface, and a plurality of nozzles disposed between the central passageway and the outer surface; and 3. A plurality of brushes extending in a direction generally outwardly from the outer surface of the drill collar tube. The brushes are preferably provided by a brush pipe assembly having a plurality of brushes extending perpendicularly from the brush pipe, the brushes being generally disposed in longitudinal rows which are separated by a plurality of longitudinal slots. The brush pipe is positioned over the drill collar tube with the slots opposite the nozzles and is secured to the drill collar tube.

The apparatus of the invention thus provides a number of improvements over the prior art.

The rotation of the brushes allows for the entire area of the perforated casing to be scrubbed by the brushes, and avoids leaving any sections not cleaned. The rotation of the brushes also allows for the bristles to actually knock the scale off the casing and not merely push the scale into the perforations.

The high pressure force used to distribute the water and/or cleaning chemical combined with the rotational motion of the apparatus distributes the water and/or cleaning chemical over the entire perforated area of the casing and into all the perforations. By using high pressure, the water and/or cleaning chemical penetrates the perforated areas more effectively, and penetrates under the scale buildup. The high pressure force opens up the perforations from the inside to the outside of the well casing, and is also very good at removing the scale buildup on the inside of the casing.

With both the rotating of the apparatus and the high pressure force cleaning the perforated area, it typically takes only one pass through the perforated section to successfully clean the area.

DESCRIPTION OF THE PREFERRED EMBODIMENTS

Figure 1:
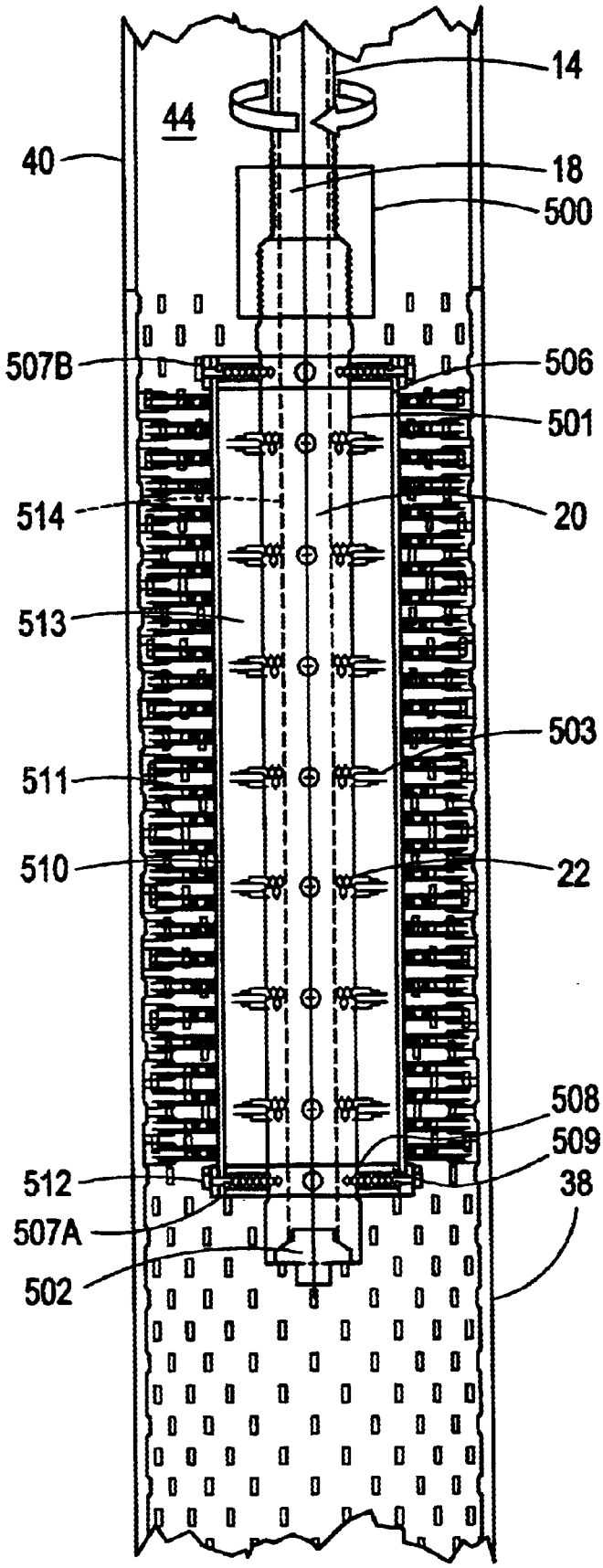
FIG. 1 is a vertical, cross-sectional view of a well casing having an apparatus according to the invention disposed therein.

As shown in FIG. 1, the apparatus of the invention is a tool that is designed to refurbish or clean the perforated area of the well casing, and is made up of (1) a coupling 500, (2) a drill collar tube assembly 501, and (3) a brush pipe assembly 506.

Coupling 500 is round and has a female thread on the top end that is coupled onto a section of drill stem 14. The bottom of the coupling 500 is threaded onto the top of drill collar tube 501. There is a passage 18 through the center of the coupling 500 that allows the liquid to flow from the drill stem into a central passage 20 of the drill collar tube 501. The coupling 501 is capable of holding 500 PSI internal pressure.

The drill collar tube 501 is a round hollow tube also capable of handling 500 PSI internal pressure. The drill collar tube includes a plurality of nozzle orifices 22 between the central passage 20 and the outer surface, the nozzle orifices each having a nozzle 503 disposed therein for projecting liquid outwardly from the central passage. Conveniently, the orifices and the nozzles are threaded for making a connection. A pipe plug 502 is used to close the lower end of the drill collar tube; conveniently, the pipe plug and drill collar tube are threaded for making the connection. Advantageously, the nozzle orifices are disposed in longitudinal mill flats 514 on the outer surface of the drill collar tube 501.

The apparatus includes a plurality of brushes disposed generally perpendicularly to the outer surface of the drill collar tube for scrubbing the well walls. While the brushes may be attached directly to the drill collar tube, it is highly advantageous to provide a brush pipe assembly 506 attached to the outside of the drill collar tube 501, the brush pipe assembly having a plurality of attached brushes in longitudinal rows which are positioned so that they do not interfere with the nozzles 503 in the drill collar tube 501. The length of the brushes used depends on the diameter of the casing that is being refurbished.

Advantageously, the brushes 511 may be inserted in brush tracks 510. A plurality of brush tracks 510 is then assembled with rings 507A and 507B at opposite ends thereof to retain the brushes in the tracks. Typically, one of the rings is attached by welding, while the other ring is slipped onto the ends of the brush tracks, and is removable to permit brushes to be changed.

The brush pipe assembly 506 is secured to the drill collar tube. As shown in FIG. 1, attachment holes 508 are provided at opposite ends of the drill collar tube, and bolt jackets 509 are threaded into the attachment holes 508. Bolts 512 are then threaded through the rings 507A and 507B into the bolt jackets 509.

Longitudinal slots 513 are disposed between the brush tracks 510. The nozzles 503 are disposed opposite the slots 513 such that the brushes do not interfere with the flow of cleaning liquid from the nozzles.

Figure 2:
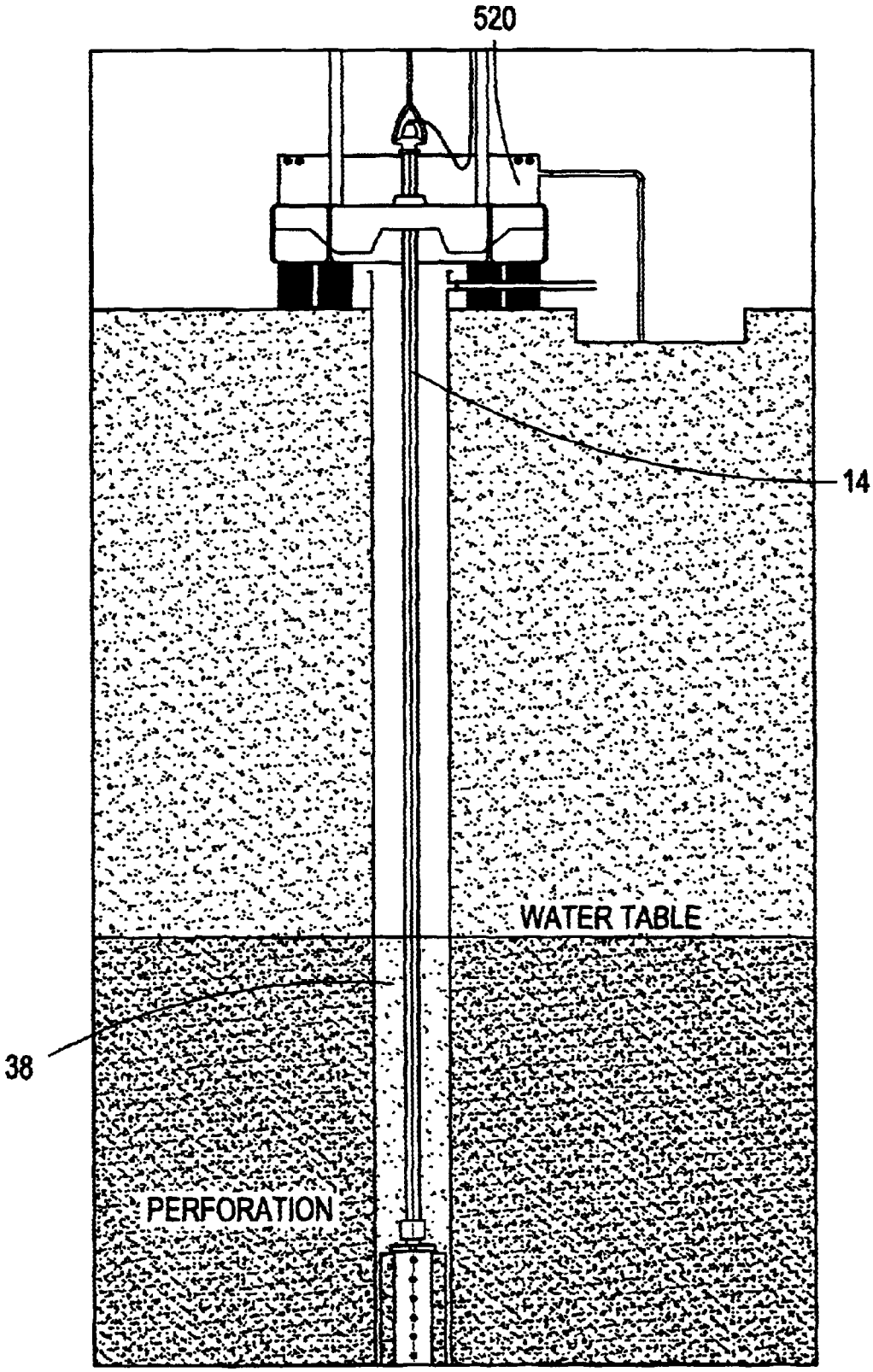
FIG. 2 is a diagram of a cleaning apparatus according to the invention disposed in a well with drill rig, drill stem and casing.

The set up of this assembly in a well is shown in FIG. 2. A drilling rig 520 is used that has the capability to rotate the drill stem, move it up and down vertically, and include a pump capable of forcing water and/or cleaning liquid through the drill stem. The drill stem 14 is threaded onto the coupling 500 of the apparatus above ground, and the apparatus is then lowered into a portion 38 of well casing 40 having perforations and is positioned at the lowest part of the perforated area 38. Water and/or a cleaning chemical is then pumped through the drill stem at high pressure into the apparatus and out through the nozzles 503 onto the perforated area 38 of the casing. At the same time, the mechanism on the drilling rig rotates the apparatus as shown by arrow 44 and pulls it up slowly. The upward motion is stopped when the brushes reach approximately 20 feet above the top of the perforated area of the casing. Typically, this process needs only be done once to effectively clean and refurbish the casing.

The refurbishing of the casing in the perforated areas occurs from three different actions:

1) The water and/or cleaning chemical that is pumped at a high pressure onto the wall of the casing is thoroughly distributed around the perforated area which helps loosen up the corrosion, bacteria and scale buildup, so that the force from the nozzles 503 and the brush pipe assembly 506 can better clean the perforated area. Moreover, as the water/chemical hits these areas with a high pressure force, it opens up the perforations from the inside to the outside of the well casing, and the scale buildup is also knocked off by the force of the water/cleaning chemical.

2) The rotation of the apparatus allows the brush pipe assembly 506 to scrub the perforations and the inside of the casing, knocking off more of the corrosion and scale buildup.

3) Pulling the apparatus up allows for the cleaning action to take place along the entire perforated section of the well casing.

This entire process opens up the perforations both on the inside and outside, and cleans the inside of the well casing. This allows for a drastic increase in the volume of water that can flow into the casing. Documented results show pumping volume increases of 8% to 50%.

What is claimed is:

1. An apparatus for cleaning a well casing, comprising:

a coupling having first and second ends, the first end constructed and arranged for connection to a drill stem of a drilling rig having vertical and rotational motion and means for pumping liquid therethrough to the coupling, the coupling having a central passageway therethrough connected to the means for pumping liquid;

a drill collar tube having first and second ends, the first end of the drill collar tube connected to the second end of the coupling, the drill collar tube comprising a central passageway therethrough connected to the central passageway of the coupling, an outer surface, a plurality of nozzles disposed between the central passageway and the outer surface, and closure means for closing the second end of the drill collar tube; and a plurality of brushes disposed generally perpendicularly to the outer surface of the drill collar tube wherein the plurality of brushes is disposed in a brush pipe assembly attached to the outer surface of the drill collar tube, the brush pipe assembly comprising said plurality of brushes, and slots in the brush pipe assembly disposed opposite to said nozzles to permit liquid to flow from said nozzles without interference from the brushes.

2. The apparatus of claim 1, wherein the plurality of brushes comprises a plurality of longitudinal rows of brushes separated by longitudinal slots.

3. The apparatus of claim 1, wherein the brush pipe assembly is secured to the drill collar tube at opposite ends thereof.

4. The apparatus of claim 3, wherein the brush pipe assembly comprises a plurality of longitudinal brush tracks with a plurality of brushes disposed in each of said brush tracks, and rings securing said brush tracks at the opposite ends of the brush pipe assembly, the rings being secured to the drill collar tube.

5. The apparatus of claim 4, wherein at least one of said rings is removable to permit changing brushes in the brush tracks.

6. The apparatus of claim 1, wherein the nozzles are secured in orifices in the drill collar tube by thread means.

7. The apparatus of claim 1, wherein the coupling is attached to the drill collar tube by thread means.

8. A method for cleaning a portion of a well casing, comprising the steps of:

a) obtaining a cleaning apparatus comprising:

a coupling having first and second ends, the first end constructed and arranged for connection to a drill stem of a drilling rig, the coupling having a central passageway therethrough connected to a means for pumping liquid;

a drill collar tube having first and second ends, the first end of the drill collar tube connected to the second end of the coupling, the drill collar tube comprising a central passageway therethrough connected to the central passageway of the coupling, an outer surface, a plurality of nozzles disposed between the central passageway and the outer surface, closure means connected to the second end of the pressure tube; and brush means disposed generally perpendicularly to the outer surface wherein the plurality of brushes is disposed in a brush pipe assembly attached to the outer surface of the drill collar tube, the brush pipe assembly comprising said plurality of brushes, and slots in the brush pipe assembly disposed opposite to said nozzles to permit liquid to flow from said nozzles without interference from the brushes; and b) attaching the first end of the coupling to a drill stem of a drilling rig having vertical and rotational motion and means for pumping liquid therethrough to the drill stem;

c) lowering the apparatus into a portion of a well to be cleaned;

d) pumping water and/or a cleaning liquid from the drilling rig into the lowered apparatus and out through the nozzles, and simultaneously imparting a rotational motion to the apparatus;

e) while pumping and imparting said rotational motion, moving the apparatus vertically through the portion of the well casing to be cleaned;

f) discontinuing the pumping, and the rotational and vertical motions; and g) removing the apparatus from the well.

9. The method of claim 8, wherein the apparatus is initially lowered to a lowest portion of the well casing to be cleaned, and the apparatus is moved vertically to above an upper portion of the well casing to be cleaned.

* * * * *